US006308950B1

(12) United States Patent
Sappal et al.

(10) Patent No.: US 6,308,950 B1
(45) Date of Patent: Oct. 30, 2001

(54) PAPER PROCESSING DEVICE WITH A TAPE REPLACEMENT APPARATUS AND METHOD OF REPLACING A TAPE OF THE PAPER PROCESSING DEVICE

(75) Inventors: Jatinder Singh Sappal, Rochester; Mark Anthony Wingate, New Durham, both of NH (US)

(73) Assignee: Heidelberger Druckmaschinen AG, Heildelberg (DE)

( * ) Notice: Subject to any disclaimer, the term of this patent is extended or adjusted under 35 U.S.C. 154(b) by 0 days.

(21) Appl. No.: 09/630,153

(22) Filed: Jul. 31, 2000

(51) Int. Cl.[7] ..... B65H 5/00

(52) U.S. Cl. ..... 271/264; 271/198; 198/817; 198/866

(58) Field of Search ..... 271/264, 275, 271/198; 198/817, 866

(56) References Cited

U.S. PATENT DOCUMENTS 3,287,013 * 11/1966 Fairbanks et al. .
4,293,087 10/1981 Schmitz .
4,861,014 * 8/1989 Martin ..... 271/198
5,673,784 * 10/1997 Karpinsky et al. ..... 198/817 X
5,692,745 * 12/1997 Neifert et al. ..... 271/198
5,954,473 * 9/1999 Folsom ..... 271/198 X

* cited by examiner

*Primary Examiner*—David H. Bollinger
(74) *Attorney, Agent, or Firm*—Herbert L. Lerner; Laurence A. Greenberg; Werner H. Stemer

(57) ABSTRACT

A paper processing device, in particular, a folder that includes an apparatus for replacing tapes that convey signatures and a method for replacing tapes of the paper processing device. The paper processing device has a frame or frames with opposing sides and a plurality of cylinders disposed between the opposing sides of the frames. Each one of the cylinders has an axis for rotation thereabout. The paper processing device includes a plurality of tapes and each one of the plurality of tapes is disposed to circulate around the plurality of cylinders. The paper processing device includes a holder for holding an end of the replacement tape that will be provided to replace one of the plurality of tapes, and an elongated conveying element disposed for circulation around the axis of the plurality of cylinders. The elongated conveying element is attached to the holder for guiding the replacement tape around the plurality of cylinders. The method includes a step of splicing two ends of the replacement tape together after the holder moves the replacement tape around the cylinders.

14 Claims, 3 Drawing Sheets

PAPER PROCESSING DEVICE WITH A TAPE REPLACEMENT APPARATUS AND METHOD OF REPLACING A TAPE OF THE PAPER PROCESSING DEVICE

BACKGROUND OF THE INVENTION

Field of the Invention

The invention relates, in general, to a paper processing device used in a printing press line, and in particular, to a paper processing device with a tape replacement apparatus that can be used to replace one or more of the tapes that carry signatures through the paper processing device.

A paper processing device, for example, a folder used in a printing press line has tapes or belts that carry signatures around the rollers of the folder. When the tapes deteriorate, get dirty, or break, they must be replaced. Replacement is usually performed by manually routing the tapes around the rollers and through the intended path. Manual replacement is time consuming and difficult because of the limited workspace that is available inside the folder. Thus, there is a need to reduce the time required for replacing the tapes.

SUMMARY OF THE INVENTION

It is accordingly an object of the invention to provide a paper processing device with a tape replacement apparatus and a method of replacing a tape or tapes of a paper processing device which overcomes the hereinaforementioned disadvantages of the heretofore-known devices and methods of this general type in such a way that the tapes which carry signatures through the paper processing device can be easily replaced.

With the foregoing and other objects in view there is provided, in accordance with the invention, a paper processing device that includes a pair of frames having opposing sides and a plurality of cylinders disposed between the opposing sides of the frames. Each one of the cylinders has an axis for rotation thereabout. The paper processing device includes a plurality of tapes each disposed to circulate around the plurality of cylinders. The paper processing device includes a holder for holding a replacement tape for replacing one of the plurality of tapes, and an elongated conveying element disposed for circulation around the axis of the plurality of cylinders. The elongated conveying element is attached to the holder for guiding the replacement tape around the plurality of cylinders.

In accordance with an added feature of the invention, the holder includes a plurality of grippers spatially distributed between the opposing sides of the frames.

With the foregoing and other objects in view there is provided, in accordance with the invention, a method of replacing a tape in a paper processing device, that includes providing a paper processing device with tapes to carry signatures and disposing the tapes such that they can move around cylinders in a predetermined path. A holder is provided that can move around cylinders in the predetermined path. A first end of a replacement tape is secured to the holder. The holder is moved in the predetermined path to route the replacement tape around the cylinders. The first end of the replacement tape is spliced to a second end of the replacement tape such that the tape can function as a tape that carries signatures.

Other features which are considered as characteristic for the invention are set forth in the appended claims.

Although the invention is illustrated and described herein as embodied in a paper processing device with a tape replacement apparatus and a method of replacing a tape of a paper processing device, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
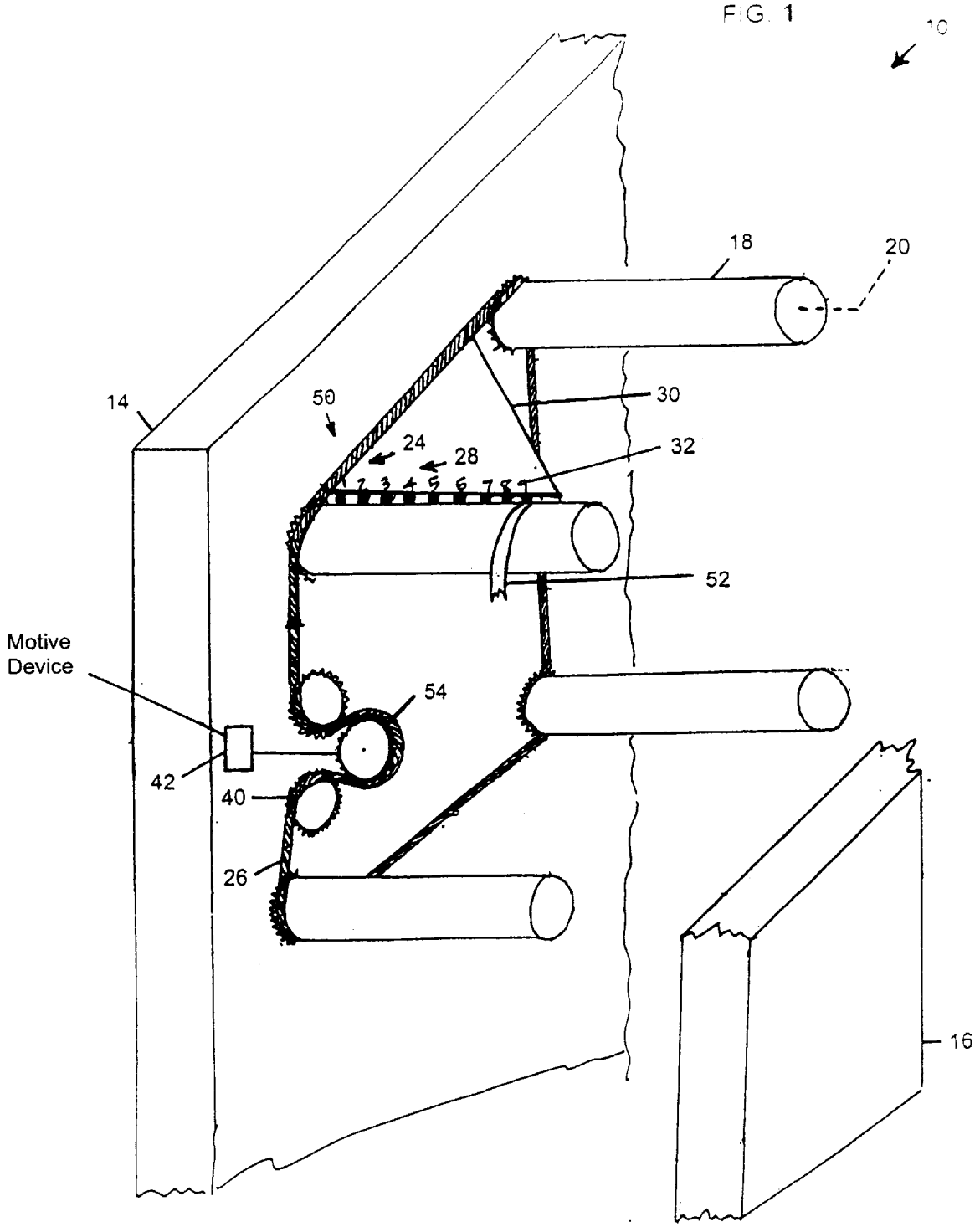
FIG. 1 is a partial perspective view of a portion of a paper processing device with a first embodiment of a tape replacement apparatus.
Figure 2:
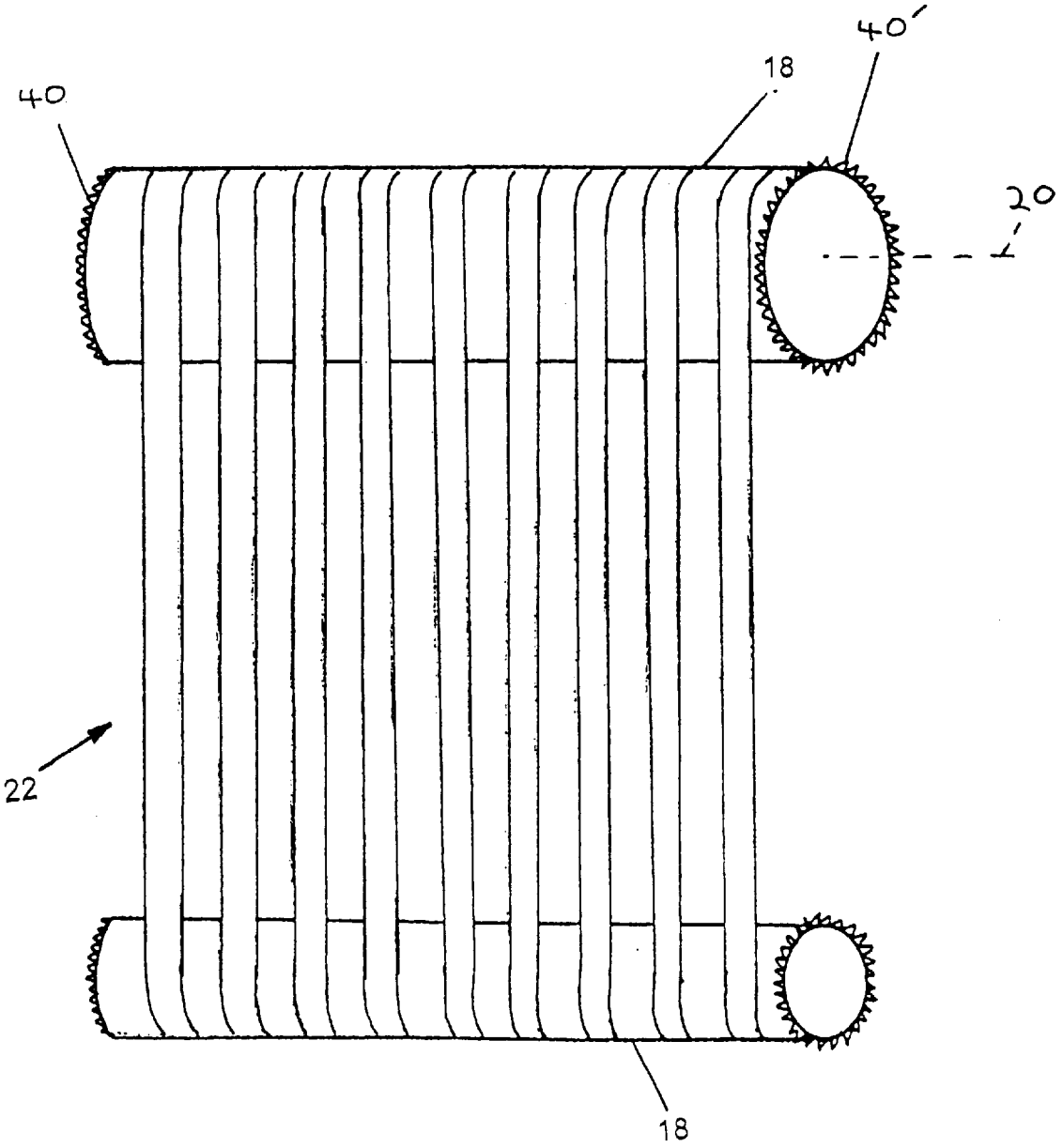
FIG. 2 is a plan view showing conveying tapes, for carrying signatures, extending between two cylinders.

Referring now to the figures in detail, and first, particularly to FIG. 1 thereof, there is seen a paper processing device 10, in this particular example, a folder for folding signatures (not shown) at the end of a printing line. only portions of the paper processing device 10 that are relevant for understanding the invention are illustrated. The paper processing device 10 includes a pair of opposing frames 14 and 16. Only a portion of frame 16 is shown so that important features of the invention can be clearly seen. A plurality of cylinders 18 are disposed between the opposing frames 14 and 16, and each one of the cylinders 18 has an axis 20 for rotation thereabout. Alternatively, only one frame, such as frame 14, can be provided and the cylinders 18 can be rotatably supported from one end thereof like a cantilever. The paper processing device 10 has a plurality of belts or conveying tapes 22 that are disposed to circulate around the cylinders 18 in order to carry signatures along a predetermined path defined by the cylinders 18. For clarity, these conveying tapes 22 are not shown in FIG. 1, however, FIG. 2 is a plan view showing the conveying tapes 22 extending between two such cylinders 18.

Referring again to FIG. 1, the paper processing device 10 is shown with a first embodiment of a tape replacement apparatus 50. The tape replacement apparatus 50 includes a holder 24, that is preferably one or more grippers 28, for holding one or more replacement tapes 52 that are provided when it is necessary to replace one or more of the conveying tapes 22. The holder 24 is attached to an elongated conveying element 26, preferably a chain, which is disposed to circulate around the axis 20 of each one of the cylinders 18. When a replacement tape 52 is secured to the holder 24 and the holder 24 is subsequently circulated by the conveying element 26, the replacement tape 52 will be moved in the predetermined path around the cylinders 18.

A plurality of guide-pieces 40, preferably sprockets, can be provided to assist in circulating the elongated conveying element 26 around the axis 20 of each one of the cylinders 18. Each one of the guide-pieces 40 are disposed to rotate around the axis 20 of a respective one of the cylinders 18. The guide-pieces 40 are disposed at one end of the cylinders 18, adjacent the side of frame 14, and preferably have diameters that are close to the outer diameters of the cylinders 18. When the guide-pieces 40 are provided as sprockets, obviously the elongated conveying element 26 will be provided as a chain. A motive device 42 in the form of a motor or a hand-wheel can be provided to cooperate with a motive guide-piece 54 that engages and circulates the elongated conveying element 26.

The holder 24 can be a single gripper for holding a replacement tape 52 that is attached to the elongated conveying element 26. However, the holder 24 is preferably a plurality of grippers 28 that are spatially distributed between the opposing frames 14 and 16. Each one of the grippers 28 is attached to the elongated conveying element 26 in a manner such that each gripper 28 is aligned with a path of a respective one of the conveying tapes 22. When it is necessary to replace a defective one of the conveying tapes 22, an end of the replacement tape 52 is secured to the gripper 28 that is aligned with the path of the defective one of the conveying tapes 22. As the gripper 28 is moved by the elongated conveying element 26, the replacement tape 52 will be moved through its proper path. The replacement tape 52 can be pre-cut into the required length or it can be taken directly off of a roll as the gripper 28 moves through the path. In the case where the replacement tape 52 is taken off of a roll, the tape 52 can be cut to the required length after being moved through the path. In each case, after the replacement tape 52 has been placed into the proper path, the ends of the replacement tape 52 are spliced together to form a continuous tape that will now properly function as one of the conveying tapes 22 that carry signatures.

A flexible sheet 30, preferably having a triangular shape, can be used to align each of the grippers 28 with the path of a respective one of the conveying tapes 22 and to attach the grippers 28 to the elongated conveying element 26. The sheet 30 must be flexible enough to allow it to bend and pass around the cylinders 18. FIG. 1 shows that the grippers 28 are attached to the long side of the triangular shaped flexible sheet 30. The flexible sheet 30 includes an indicator 32 for indicating a desired position for the replacement tape 52. The indicator 32 could be formed by a simple marking on the sheet 30 indicating the position of each one of the conveying tapes 22.

Figure 3:
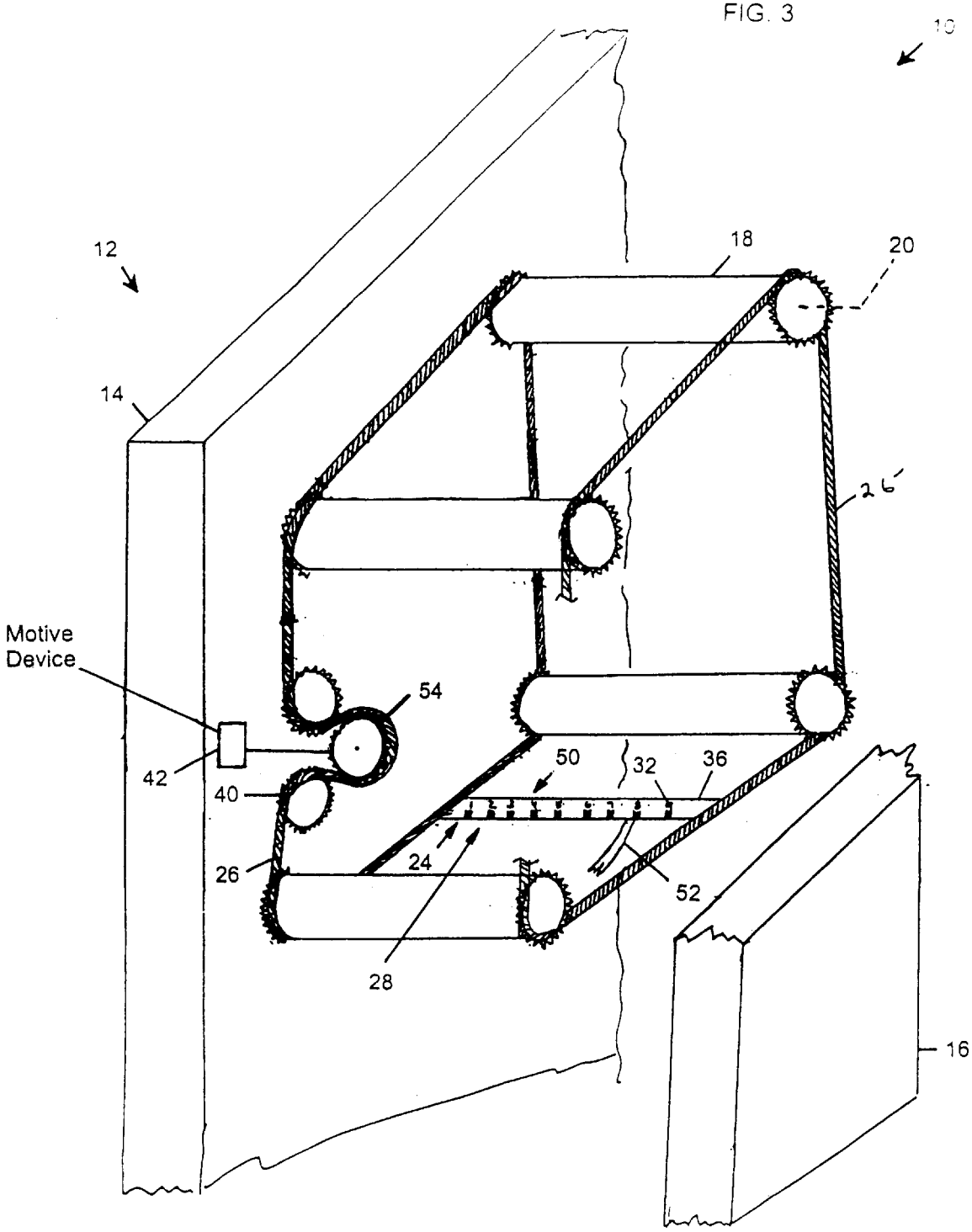
FIG. 3 is a partial perspective view of a portion of a paper processing device with a second embodiment of a tape replacement apparatus.

Referring now to FIG. 3, there is seen a paper processing device 10, in this particular example, a folder, with a second embodiment of the tape replacement apparatus 50'. Components that are identical to those shown in FIG. 1 have been indicated using the same reference numerals. Components that are constructed differently from those shown in FIG. 1 and additional components that are otherwise identical to corresponding components shown in FIG. 1 have been indicated using reference numerals with a prime symbol, for example, 50'. The second embodiment of the tape replacement apparatus 50' differs from the first embodiment in the manner in which the holder 24 is attached to the elongated conveying element 26. The tape replacement apparatus 50' includes another elongated conveying element 26', preferably a chain, that is conveyed by guide-pieces 40', preferably sprockets, that are disposed adjacent the other opposing frame 16. For clarity, only a portion of the elongated conveying element 26' has been shown. It should be understood that the elongated conveying element 26' is preferably disposed to circulate around the axis 20 of each one of the cylinders 18. In this case, each of the elongated conveying elements 26 and 26' can be driven to rotate the cylinders 18. A connecting piece 36, preferably a bar, is connected between the two elongated conveying elements 26 and 26'. A plurality of grippers 28 are attached to the connecting piece 36 in a spatially distributed manner between the elongated conveying elements 26 and 26'. The connecting piece 36 is provided with an indicator 32 for indicating a desired position for the replacement tape 52. The indicator 32 could be formed by a simple marking on the connecting piece 36 indicating the position of each one of the conveying tapes 22.

We claim:

1. A paper processing device, comprising:

at least one frame;

a plurality of cylinders rotatably mounted to said frame, each one of said cylinders having an axis for rotation thereabout;

a plurality of tapes each disposed to circulate around said plurality of cylinders;

a holder for holding a replacement tape for replacing one of said plurality of tapes; and an elongated conveying element disposed for circulation around said axis of said plurality of cylinders, said elongated conveying element attached to said holder for guiding the replacement tape around said plurality of cylinders.

2. The paper processing device according to claim 1, wherein said holder is a gripper.

3. The paper processing device according to claim 1, wherein said holder includes a plurality of grippers spatially distributed away from said frame, each one of said plurality of grippers for holding a replacement tape for replacing one of said plurality of tapes.

4. The paper processing device according to claim 1, comprising:

a flexible sheet attaching said holder to said elongated conveying element;

said holder including a plurality of grippers which are spatially away from said frame, each one of said plurality of grippers for holding at least one replacement tape for replacing at least one of said plurality of tapes.

5. The paper processing device according to claim 4, wherein said flexible sheet includes an indicator for indicating a desired position for the replacement tape.

6. The paper processing device according to claim 4, wherein said flexible sheet is formed in a triangular shape.

7. The paper processing device according to claim 1, comprising:

a pair of opposing frames defined by said frame and another frame that is disposed opposite said frame;

a first elongated conveying element defined by said elongated conveying element and disposed adjacent one of said opposing frames;

a second elongated conveying element disposed adjacent the other one of said opposing frames; and a connecting piece attached to said first elongated conveying element and to said second elongated conveying element;

said holder secured to said connecting piece.

8. The paper processing device according to claim 7, wherein said holder includes a plurality of grippers spatially distributed between said opposing frames, each one of said plurality of grippers for holding a replacement tape for replacing one of said plurality of tapes.

9. The paper processing device according to claim 7, wherein said connecting piece includes an indicator for indicating a desired position for the replacement tape.

10. The paper processing device according to claim 1, comprising a plurality of guide-pieces, each one of said plurality of guide-pieces disposed to rotate about the axis of a respective one of said plurality of cylinders, said plurality of guide-pieces for circulating said elongated conveying element around said axis of said plurality of cylinders.

11. The paper processing device according to claim 10, wherein said plurality of guide-pieces are sprockets and said elongated conveying element is a chain.

12. The paper processing device according to claim 1, comprising a motor for circulating said elongated conveying element.

13. The paper processing device according to claim 1, comprising a hand-wheel for circulating said elongated conveying element.

14. A method of replacing a tape in a paper processing device, which comprises:

providing a paper processing device with tapes to carry signatures;

disposing the tapes such that they can move around cylinders in a predetermined path;

providing a holder that can move around cylinders in the predetermined path;

securing a first end of a replacement tape to the holder;

moving the holder in the predetermined path to route the replacement tape around the cylinders; and splicing the first end of the replacement tape to a second end of the replacement tape.

* * * * *